United States Patent [19]

Gray

[11] 4,444,674

[45] Apr. 24, 1984

[54] GRANULAR BLEACH ACTIVATOR COMPOSITIONS AND DETERGENT COMPOSITIONS CONTAINING THEM

[75] Inventor: Ian Gray, Newcastle upon Tyne, England

[73] Assignee: The Procter & Gamble Company, Cincinnati, Ohio

[21] Appl. No.: 476,439

[22] Filed: Mar. 17, 1983

Related U.S. Application Data

[63] Continuation of Ser. No. 316,478, Oct. 30, 1981, abandoned.

[30] Foreign Application Priority Data

Nov. 6, 1980 [GB] United Kingdom ..... 8035709
Oct. 23, 1981 [GB] United Kingdom ..... 8132013

[51] Int. Cl.[3] ..... C11D 7/38; C11D 11/00

[52] U.S. Cl. ..... 252/95; 252/91; 252/99; 252/102; 252/174.13; 252/174.21; 252/174.22; 252/174.25; 252/186.27; 252/186.38

[58] Field of Search ..... 252/91, 95, 99, 102, 252/89.1, 174.13, 174.21, 174.22, 174.25, 186.27, 186.38

[56] References Cited

U.S. PATENT DOCUMENTS

| | | | |
|---|---|---|---|
| 3,441,507 | 4/1969 | Schiefer et al. | 252/95 |
| 3,868,336 | 2/1975 | Mazzola et al. | 252/527 |
| 3,925,234 | 12/1975 | Hachmann et al. | 252/186 |
| 4,064,062 | 12/1977 | Yurko | 252/99 |
| 4,087,369 | 5/1978 | Wevers | 252/102 |
| 4,111,826 | 9/1978 | Leigh et al. | 252/174.21 |
| 4,248,911 | 2/1981 | Wixon | 252/91 X |
| 4,248,928 | 2/1981 | Spadini et al. | 428/286 |
| 4,290,093 | 9/1981 | Macgilp et al. | 252/91 |
| 4,321,157 | 3/1982 | Harris | 252/174.25 |
| 4,339,335 | 7/1982 | Wixon | 252/8.8 |
| 4,399,049 | 8/1983 | Gray et al. | 252/91 |

FOREIGN PATENT DOCUMENTS

| | | |
|---|---|---|
| 6655 | 1/1980 | European Pat. Off. . |
| 28432 | 5/1981 | European Pat. Off. . |
| 2538680 | 3/1975 | Fed. Rep. of Germany . |
| 2406410 | 8/1975 | Fed. Rep. of Germany . |
| 2365269 | 10/1975 | Fed. Rep. of Germany . |
| 2741680 | 3/1978 | Fed. Rep. of Germany . |
| 1398785 | 6/1975 | United Kingdom . |
| 1504211 | 3/1978 | United Kingdom . |

*Primary Examiner*—P. E. Willis, Jr.

[57] ABSTRACT

Granular detergent compositions comprising an agglomerate of finely-divided organic peroxy acid bleach precursor, and water-soluble or water-dispersible organic binding agent having a melting point of no more than 40° C., and having a surface coating of water-insoluble natural or synthetic silica or silicate. The compositions have improved granular physical characteristics, chemical stability and rate of solution/dispersion characteristics.

20 Claims, No Drawings

GRANULAR BLEACH ACTIVATOR COMPOSITIONS AND DETERGENT COMPOSITIONS CONTAINING THEM

This is a continuation, of application Ser. No. 316,478, filed Oct. 30, 1981, now abandoned.

TECHNICAL FIELD

The present invention relates to bleach activator compositions, their manufacture and use in granular detergent compositions. In particular it pertains to compositions containing activators in the form of organic peroxyacid bleach precursors.

BACKGROUND

It is well known that peroxygen bleaching agents, e.g., perborates, percarbonates, perphosphates, persilicates etc., are highly useful for chemical bleaching of stains found on both colored and white fabrics. Such bleaching agents are most effective at high wash solution temperatures, i.e., above about 70° C. In recent years, attempts have been made to provide bleaching compositions that are effective at lower wash solution temperatures, i.e., between room temperature and 70° C. In consequence, bleaching agents have been investigated which exhibit their optimum bleach activity in this temperature range. These low temperature bleaches are useful in a variety of products intended for use under machine or hand-wash conditions, e.g., additive, pre-additive or soak-type laundry compositions as well as all-purpose detergent compositions.

A very effective class of low temperature bleach system comprises a peroxy bleach compound and an organic peracid precursor which react together to form the organic peracid in the wash solution. Examples of detergent compositions incorporating bleaching agents of this type are disclosed in U.S. Pat. No. 2,362,401 (Reicher et al), U.S. Pat. No. 3,639,248 (Moyer) and in British Pat. Nos. 836,988 and 855,735.

It is well-known, however, that bleach activator containing detergent compositions suffer a number of technical problems which until now have limited their commercial applicability and market success. The underlying problem is that of activator instability, i.e., the tendency of the activator to degrade by hydrolysis and perhydrolysis reactions under the alkaline and oxidizing conditions typically encountered in detergent compositions during storage. This leads not only to loss of bleaching efficacy but also to degradation of other sensitive ingredients in the detergent formula, for example, perfumes, optical brighteners, enzymes, dyes etc.

In the art, two major approaches have been used to tackle the instability problem. In the first approach, the activator is protected from its hostile alkaline/oxidizing environment by agglomeration, coating or encapsulation with a non-hygroscopic, preferably hydrophobic agglomerating, coating or encapsulating material (see for instance British Pat. Nos. 1,441,416 and 1,398,785, U.S. Pat. Nos. 3,494,786 (Neilson), 3,494,787 (Lund and Neilson) and 3,441,507 (Schiefer)). This technique suffers the disadvantage, however, that to be efficaceous, the agglomerating or coating material must be so water-impervious as to considerably inhibit the rate of release of bleach activator into the detergent wash liquor. This leads to diminished bleach effectiveness and increased cost. Where, on the other hand, a hydrophilic agglomerating or coating agent is used, for instance, a water-soluble liquid nonionic surfactant, the hygroscopicity of the product is such that no meaningful improvement in activator stability can be achieved. For this reason, a number of patents (for instance British Pat. No. 1,561,333 and European patent application No. 6655) advocate the use of normally solid nonionic surfactants as agglomerating or coating agents and this can indeed lead to some improvement in hygroscopicity. Once again, however, agglomerates of this type typically display poor activator-release characteristics and diminished bleach effectiveness.

In the second approach to improving activator stability, the activator is incorporated in the detergent composition in the form of relatively coarse-sized particles (see, for instance, U.S. Pat. No. 4,087,369), the object being to reduce interaction of the activator with its environment by minimizing the surface/unit weight of the activator. This approach suffers the disadvantage, however, that the rate of dispersion and solubilization of the activator is so slow as to considerably increase the risk of fabric damage known as "pinpoint spotting". In essence, "pinpoint spotting" is a local bleach effect caused by slow dissolution of individual particles of the bleach system resulting in a locally high concentration of the bleaching agent at the fabric surface. High solubilization rate is thus seen to be critical for avoiding problems of damage to fabrics, but in as much as high solubilization rate has traditionally implied either a high activator surface/unit weight or agglomeration with a hygroscopic agglomerating agent, it follows that the twin aims of improving fabric safety and activator stability have been to a large degree mutually exclusive.

The present invention seeks, as one of its objectives, to resolve these conflicting requirements by providing a matrix of materials in particulate form that has excellent granular physical characteristics, activator stability and rate of solution/dispersion characteristics; that delivers these benefits in a composition comprising high levels of detergent functional nonionic surfactants; and which also delivers these benefits in a detergent composition prepared from highly alkaline and oxidizing detergent components.

As used herein below, the terms "bleach activator" and "organic peroxy acid bleach precursor" are directly equivalent to one another.

SUMMARY OF THE INVENTION

Accordingly, the present invention provides a granular bleach activator composition in the form of an agglomerate comprising by weight thereof:

(a) at least 55% of finely-divided organic peroxy acid bleach precursor, (b) from 1% to 25% of water-soluble or water-dispersible organic binding agent for the bleach precursor, the binding agent having a melting point of no more than 40° C., (c) from 1% to 25% of finely-divided water-insoluble natural or synthetic silica or silicate as a surface-coating agent for the agglomerate, the weight ratio of the bleach precursor binding agent to surface-coating agent lying in the range from 10:1 to 1:6.

The bleach activator is thus incorporated in a matrix of water-soluble or water-dispersible liquid binding agent and coated with a surface-coating of water-insoluble silica or silicate to provide an agglomerate of low hygroscopicity, good flow characteristics, and excellent activator stability and dispersibility characteristics. Surprisingly, the coating agent acts to increase the rate of dispersion of the agglomerate, even though the coating agent is itself water-insoluble. The hygroscopicity of the agglomerate can be determined by measuring the weight % of moisture-pickup of granules of the agglomerate after 72 hours storage at 32° C. and 80% relative humidity. Preferably, the moisture-pickup under these conditions is less than about 6%, more preferably less than about 3.5% and desirably less than about 1.5% by weight of the agglomerate.

With regard to the water-insoluble silica or silicate, this preferably has an average primary particle size (i.e. number average particle diameter for the primary crystals or primary aggregates as obtained, for instance, from electron microscope measurements) of less than 4 microns, more preferably less than 1μ, and an average secondary particle size (i.e. the weight-average particle diameter measured, for instance, by screening) of less than 500μ, preferably less than 300μ. Preferably, also, the silica or silicate has an external surface area (measured, for instance, by dye adsorption) of at least 5 sq. meter/g., more preferably at least 15 sq. meter/g.

With regard to chemical composition, the water-insoluble silicate can be selected from aluminosilicates of the clay or zeolite classes or, more preferably, is a magnesium silicate type of material. Aluminosilicates of the clay variety are preferably sheet-like natural clays, especially those selected from the smectite-type and kaolinite-type groups. Highly suitable smectite-type clays include alkali and alkaline-earth metal montmorillonites, saponites and hectorites; highly suitable kaolinite-type materials include kaolinite itself, calcined kaolin and metakaolin.

Other suitable water-insoluble silicates include aluminosilicates of the zeolite type, particularly those of the general formula I $$Na_z(AlO_2)_z(SiO_2)_yxH_2O \qquad \text{I}$$

wherein z and y are integers of at least about 6, the molar ratio of z to y is in the range from about 1.0 to about 0.5 and x is a number such that the moisture content of the aluminosilicate is from about 10% to about 28% by weight thereof. Particularly preferred material of the zeolite class are those prepared from clays themselves, especially A-type zeolites prepared by alkali treatment of calcined kaolin.

A highly preferred water-insoluble silicate, however, is a magnesium silicate of formula II $$n\ MgO{:}SiO_2 \qquad \text{II}$$

wherein n is in the range from about 0.25 to about 4.0, especially from about 0.3 to about 1.5.

With regard to the binding agent, this has a melting point of no more than about 40° C., preferably no more than about 36° C., and is preferably soluble or dispersible in water to an extent of at least 1% by weight at 20° C. In this context "dispersible" means that the binding agent is stable to separation from water in a centrifuge at 3000 r.p.m. over 16 hours. A highly preferred binding agent is an alkoxylated nonionic surfactant, especially an ethoxylated nonionic surfactant having an average HLB in the range from about 9.5 to about 13.5. This is found to provide granules having the optimum combination of hydrophobicity and water-dispersibility. Highly suitable nonionic surfactants of this type are ethoxylated primary or secondary $C_{9-18}$ alcohols having an average degree of ethoxylation from about 3 to about 12.

In the case of binding agents consisting of a complex mixture of materials, melting point can be a poorly defined parameter. The solid-to-liquid thermal transition can be monitored therefore, using a differential scanning calorimeter (Dupont R90) and the transition characterized by the (weighted) average temperature of the corresponding endotherm.

In a preferred embodiment the agglomerate comprises at least 3%, more preferably from about 5% to about 20%, especially from about 8% to about 15% of the binding agent, and up to about 3%, more preferably from 1.1% to 2.5%, especially from 1.2% to 2.1% of surface coating agent. These agglomerates are preferred from the viewpoint of optimum dispersibility in water. Agglomerates having a higher level of surface-coating agent, however, eg., a level from about 3% to 25%, can also be used herein. In these agglomerates, the weight ratio of coating agent to binding agent preferably lies in the range from about 5:1 to about 1:2.

The organic peroxy acid bleach precursor, on the other hand, preferably comprises at least 60%, more preferably at least 70%, especially at least 75%, of the agglomerate. The agglomerate itself preferably has an average particle size of from 150μ to about 3000μ, more preferably from about 500μ to about 1400.

The pH characteristics of the agglomerate are also of some importance and, desirably, the agglomerate has a pH in 2% aqueous dispersion thereof of from about 2.0 to about 9.0, especially from about 3 to about 8.5, more especially from about 4 to about 7. If necessary, optimization of the pH to within the above range can be effected by means of a separate pH regulating agent. Control of pH is desirable, especially in the case of the zeolites, for aiding stabilization of the bleach activator agains hydrolytic and perhydrolytic degradation and against base-catalysed nucleophilic attack, and is particularly effective in these respects in the moisture-controlled environment of the coated agglomerate.

The present invention also envisages use of the bleach activator agglomerate either as a granular detergent composition in its own right, or as a component of a granular detergent composition in a level generally of at least about 0.5% by weight of the detergent composition. A preferred granular detergent composition thus comprises:

(a) from about 0.5% to about 60%, preferably from about 1% to about 15% of the granular bleach activator composition, and (b) from about 40% to about 99.5%, preferably from about 85% to about 99% of auxiliary detergent components in powder form comprising:

(i) from about 5% to about 35%, preferably from about 15% to about 25% of inorganic per-compound yielding hydrogen peroxide in water, (ii) from about 1% to about 30% preferably from about 3% to about 20% of anionic surfactant, optionally in combination with nonionic, cationic, zwitterionic or ampholytic surfactant or mixture thereof, and (iii) from about 2% to about 93.5% preferably from about 10% to about 60% of detergency builder.

A further highly preferred though optional component of the composition is a polyphosphonic acid or salt thereof, particularly those having the general formula:

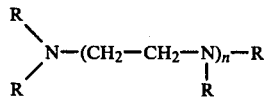

in which n is an integral number from 1 to 14 and each R is individually hydrogen or $CH_2PO_3H_2$ or a water-soluble salt thereof, provided that at least half of the radicals represented by R are $CH_2PO_3H_2$ radicals or water-soluble salts thereof, the weight ratio of water-insoluble silica or silicate to the polyphosphonic acid lying in the range from 100:1 to 1:5. Especially preferred are diethylene triamine penta (methylene phosphonic acid); ethylene diamine tetra (methylene phosphonic acid) and salts thereof. These can be included either in the agglomerate or in the remainder of the composition in levels of from about 0.5% to about 10%, preferably about 4% to about 10% by weight of the agglomerate or about 0.1% to 4% by weight of the total composition. The polyphosphonates have been found to be uniquely effective in stabilizing organic peroxyacids in the presence of trace water-insoluble transition metal complexes introduced into the compositin via the water-insoluble silica or silicate.

In a process of making the compositions of the invention, particles of a mixture of the bleach precursor and binding agent are formed, the particles preferably having an average particle size of less than 3000 microns and thereafter the particles are coated with the finely-divided water-insoluble natural or synthetic silica or silicate. The agglomerates can thereafter be screened. In a preferred process, the organic binder is dispersed in liquid form onto a moving bed of the organic peroxy acid bleach precursor and the water-insoluble silica or silicate is subsequently dispersed onto a moving bed of the mixture of bleach precursor and organic binder, thereby forming the agglomerate. The process can be performed in, for instance, a pan agglomerator, Schugi mixer of fluidized bed apparatus.

The various components of the compositions of the invention will now be discussed in more detail.

As described earlier, the water-insoluble silica or silicate can be a mineral clay selected from the smectite-type and kaolinite type groups.

There are two distinct classes of smectite clays that can be broadly differentiated on the basis of the numbers of octahedral metal-oxygen arrangements in the central layer for a given number of silicon-oxygen atoms in the outer layers. The dioctahedral minerals are primarily trivalent metal ion-based clays and are comprised of the prototype pyrophyllite and the members montmorillonite $(OH)_4Si_{4/y}(Al_{4-x}Mg_x)O_{20}$, nontronite $(OH)_4Si_{4/y}(Al_{4-x}Fe_x)O_{20}$, and volchonskoite $(OH)_4Si_{4/y}(Al_{4-x}Cr_x)O_{20}$, where x has a value of from 0 to about 4.0 and y has a value of from 0 to about 2.0.

The trioctahedral minerals are primarily divalent metal ion based and comprise the prototype talc and the members hectorite $(OH)_4Si_{8-y}Al_y(Mg_{6-x}Li_x)O_{20}$, saponite $(OH)_4(Si_{8-y}Al_y)(Mg_{6-x}Al_x)O_{20}$, sauconite $(OH)_4Si_{8-y}Al_y(Zn_{6-x}Al_x)O_{20}$, vermiculite $(OH)_4Si_{8-y}Al_y(Mg_{6-x}Fe_x)O_{20}$, wherein y has a value of 0 to about 2.0 and x has a value of 0 to about 6.0.

While all of the above smectite-type clays can be incorporated in the compositions of the invention, particularly preferred smectite-type clays have ion-exchange capacities of at least 50 meq/100 g clay (measured, for instance, as described in "The Chemistry and Physics of Clays", p.p 264–265, Interscience (1979)). Especially preferred materials of this type include alkali and alkaline earth metal montmorillonites, saponites and hectorites, specific examples of which are as follows:

- Sodium Montmorillonite
  - Brock
  - Volclay BC
  - Gelwhite GP
  - Thixo-Jel 1
  - Ben-A-Gel
  - Imvite
- Sodium Hectorite
  - Veegum F
  - Laponite SP
- Sodium Saponite
  - Barasym NAS 100
- Calcium Montmorillonite
  - Soft Clark
  - Gelwhite L
- Lithium Hectorite
  - Barasym LIH 200

Smectite-type clays as described above, having a primary particle size of less than about 0.05/$\mu$ and an external surface area greater than about 15 $m^2/g$, preferably greater than about 50 $m^2/g$ are particularly suitable in the present compositions. In practice however, these clays tend to exist as larger-sized agglomerates having agglomerate size of from about 1$\mu$ to about 75$\mu$. Their moisture content is preferably adjusted to within the range from about 8% to about 20%, especially from about 10% to 15% by weight of the clay.

Turning to the kaolinite-type clays, kaolinite itself is well-recognized as a light-coloured, powdery material having the approximate formula:

$$Al_2O_3SiO_22H_2O$$

and a specific gravity of about 2.6. The kaolinites useful in the present invention are naturally derived, i.e. they are not synthetic minerals and in consequence often contain minor proportions (<2%) of iron, calcium, magnesium and titanium oxides. The kaolinites may be subjected to special processing, e.g. by calcining to give metakaolin of approximate formula $Al_2Si_2O_7$, or may be surface modified with inorganic materials such as alumina. The kaolinite clays should have a mean particle size of less than about 1 micron, preferably less than 0.5 microns and preferred clays also have a specific surface of at least 10 $m^2$/gram; most preferably at least 15 $m^2$/gram.

Because kaolinite clays are non-swelling in character, their particle size in the dry state is substantially the same as that in the wet (dispersed) state. In this context, particularly useful commercially available kaolinite clays are those which are treated by the so-called "wet process" i.e., are purified by a water washing procedure and are accordingly in a "dispersed" form.

Specific non-limiting examples of commercial kaolinite clays useful herein include Hydrite 10, Kaophile 2 and Hydrite UF, all available from the Georgia Kaolin Company, Hydrasperse and Hydrasheen 90, available from the J. M. Huber Corporation and Kaolin M100 available from English China Clays.

Other suitable water-insoluble silicates include aluminosilicates of the zeolite-type, particularly those of the general formula:

$$Na_z(AlO_2)_z(SiO_2)_yxH_2O$$

wherein z and y are integers of at least 6, the molar ratio of z to y is in the range from 1.0 to 0.5 and x is a number such that the moisture content of the aluminosilicate is from about 10% to about 28% by weight. Preferred aluminosilicates of this type belong to the faujasite group and include faujasite itself and the synthetic zeolites A, X and Y conventionally represented by the following formulae:

$Na_{12}(AlO_2)_{12}(SiO_2)_{12}.27H_2O$ Zeolite A $Na_{86}(AlO_2)_{86}(SiO_2)_{106}264H_2O$ Zeolite X $Na_6(AlO_2)_6(SiO_2)_{10}15H_2O$ Zeolite Y Highly preferred zeolites are prepared from metakaolin by treatment at about 80°-100° C. either with alkali alone (in the case of zeolites having a 1:1 $AlO_2$:$SiO_2$ ratio such as Zeolite A) or with mixtures of alkali and additional silica provided, for instance, in the form of sodium silicate or colloidal silica (in the case of zeolites having $AlO_2$:$SiO_2$ ratios of less than 1, e.g. Zeolite X).

Preferably, the aluminosilicates have an average primary particle size of less than about 4 microns, especially less than about 1 micron, and an external surface area in excess of about 5 $m^2/g$, especially greater than about 10 $m^2/g$.

A highly preferred water-insoluble silicate is a magnesium silicate of formula II:

$nMgO:SiO_2$ II wherein n is in the range from about 0.25 to about 4.0, preferably from about 0.3 to about 1.5. A highly preferred magnesium silicate is colloidal and has an MgO:-$SiO_2$ ratio of about 0.3125.

Other suitable water-insoluble silicas or silicates include those having an amorphous or gel-like structure, for example, silica aerogels, amorphous aluminosilicates, precipitated silica, silica xerogels and fumed silica.

Organic peroxy acid bleach precursors or, bleach activators as they are usually known, are well known in the art and are described extensively in the literature.

Examples of various classes of peroxy acid bleach precursors include:

(a) Esters

Esters suitable as peroxy compound precursors in the present invention include esters of monohydric substituted and unsubstituted phenols, substituted aliphatic alcohols in which the substituent group is electron withdrawing in character, mono- and disaccharides, N-substituted derivatives of hydroxylamine and esters of imidic acids. The phenol esters of both aromatic and aliphatic mono-and dicarboxylic acids can be employed. The aliphatic esters can have 1 to 20 carbon atoms in the acyl group, examples being phenyl laurate, phenyl myristate, phenyl palmitate and phenyl stearate. Of these, 1-acetoxy benzoic acid and methyl o-acetoxy benzoate are especially preferred. Diphenyl succinate, diphenyl azeleate and diphenyl adipate are examples of phenyl aliphatic dicarboxylic acid esters. Aromatic esters include phenyl benzoate, diphenyl phthalate and diphenyl isophthalate.

A specific example of an ester of a substituted aliphatic alcohol is trichloroethyl acetate. Examples of saccharide esters include glucose penta-acetate and sucrose octa-acetate. An exemplary ester of hydroxylamine is acetyl aceto hydroxamic acid.

These and other esters suitable for use as peroxy compound precursors in the present invention are fully described in British Pat. Nos. 836988 and 1147871.

A further group of esters are the acyl phenol sulphonates and acyl alkyl phenol sulphonates. An example of the former is sodium acetyl phenol sulphonate (alternatively described as sodium p-acetoxy benzene sulphonate). Examples of acyl alkyl phenol sulphonates include sodium 2-acetoxy 5-dodecyl benzene sulphonate, sodium 2-acetoxy 5-hexyl benzene sulphonate and sodium 2-acetoxy capryl benzene sulphonate. The preparation and use of these and analogous compounds is given in British Pat. Nos. 963135 and 1147871.

Esters of imidic acids have the general formula:

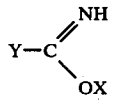

wherein X is substituted or unsubstituted $C_1$–$C_{20}$ alkyl or aryl and Y can be the same as X and can also be —$NH_2$. An example of this class of compounds is ethyl benzimidate wherein Y is $C_6H_5$ and X is ethyl.

Other specific esters include p-acetoxy acetophenone and 2,2-di-(4-hydroxyphenyl) propane diacetate. This last material is the diacetate derivative of 2,2-di(4-hydroxyphenyl) propane more commonly known as Bisphenol A which is an intermediate in the manufacture of polycarbonate resins. Bisphenol A diacetate and methods for its manufacture are disclosed in German DAS No. 1260479 published Feb. 8th, 1968 in the name of VBB Chemiefaserwork Schwarza "Wilhelm Piesh".

(b) Imides

Imides suitable as organic peroxy compound precursors in the present invention are compounds of formula:

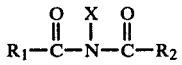

in which $R_1$ and $R_2$, which can be the same or different are independently chosen from a $C_1$–$C_4$ alkyl group or an aryl group and X is an alkyl, aryl or acyl radical (either carboxylic or sulphonic). Typical compounds are those in which $R_1$ is a methyl, ethyl, propyl or phenyl group but the preferred compounds are those in which $R_2$ is also methyl, examples of such compounds being N,N-diacetylaniline, N,N-diacetyl-p-chloroaniline and N,N-diacetyl-p-toluidine. Either one of $R_1$ and $R_2$ together with X may form a heterocyclic ring containing the nitrogen atom. An illustrative class having this type of structure is the N-acyl lactams, in which the nitrogen atom is attached to two acyl groups, one of which is also attached to the nitrogen in a second position through a hydrocarbyl linkage. A particularly preferred example of this class is N-acetyl caprolactam. The linkage of the acyl group to form a heterocyclic ring may itself include a heteroatom, for example oxygen, and N-acyl saccharides are a class of precursors of this type.

Examples of cyclic imides in which the reactive centre is a sulphonic radical are N-benzene sulphonyl phthalimide, n-methanesulphonyl succinimide and N-benzene sulphonyl succinimide. These and other N-sulphonyl imides useful herein are described in British Patent Specification No. 1242287.

Attachment of the nitrogen atoms to three acyl groups occurs in the N-acylated dicarboxylic acid imides such as the N-acyl phthalimides, N-acyl succinimides, N-acyl adipimides and N-acyl glutarimides. Imides of the above-mentioned types are described in British Patent Specification No. 855735 the disclosures of which are hereby incorporated specifically herein by reference.

Two further preferred groups of materials in this class are those in which X in the above formula is either a second diacylated nitrogen atom i.e. substituted hydrazines, or a difunctional hydrocarbyl groups such as a $C_1$–$C_6$ alkylene group further substituted with a diacylated nitrogen atom i.e. tetra acylated alkylene diamines.

Particularly preferred compounds are N,N,N',N'-tetra acetylated compounds of formula:

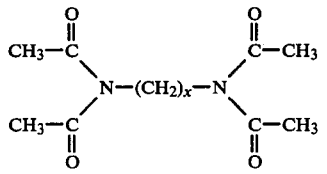

in which x can be 0 or an integer between 1 and 6, examples are tetra acetyl methylene diamine (TAMD) where x=1, tetra acetyl ethylene diamine (TAED) where x=2, and tetra acetyl hexamethylene diamine (TAHD) where x=6. Where x=0 the compound is tetra acetyl hydrazine (TAH). These and analogous compounds are described in British Patent Specification Nos. 907,356, 907,357, and 907,358.

Acylated glycourils form a further group of compounds falling within the general class of imide peroxy compound precursors. These materials have the general formula:

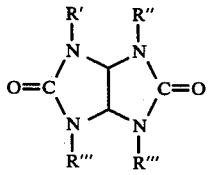

in which at least two of the R groups represent acyl radicals having 2 to 8 carbon atoms in their structure. The preferred compound is tetra acetyl glycouril in which the R groups are all $CH_3CO$— radicals. The acylated glycourils are described in British Patent Specification Nos. 1246338, 1246339, and 1247429.

Other imide-type compounds suitable for use as peroxy compound precursors in the present invention are the N-(halobenzoyl) imides disclosed in British Patent Specification No. 1247857, of which N-m-chloro benzoyl succinimide is a preferred example, and poly imides containing an N-bonded-COOR group, e.g., N-methoxy carbonyl phthalimide, disclosed in British Patent Specification No. 1244200.

N-acyl and N,N'-diacyl derivatives of urea are also useful peroxy compound precursors for the purposes of the present invention, in particular N-acetyl dimethyl urea, N,N'-diacetyl ethylene urea and N,N'-diacetyl dimethyl urea. Compounds of this type are disclosed in Netherlands Patent Application No. 6504416 published Oct. 10th, 1966. Other urea derivatives having inorganic persalt activating properties are the mono- or di-N-acylated azolinones disclosed in British Patent Specification No. 1379530.

Acylated hydantoin derivatives also fall within this general class of organic peroxy compound precursors. The hydantoins may be substituted e.g. with lower alkyl groups and one or both nitrogen atoms may be acylated. Examples of compounds of this type are N-acetyl hydantoin, N,N-diacetyl, 5,5-dimethyl hydantoin, 1-phenyl; 3-acetyl hydantoin and 1-cyclohexyl, 3-acetyl hydantoin. These and similar compounds are described in British Patent Specification Nos. 965672 and 1112191.

Another class of nitrogen compounds of the imide type are the N,N-diacyl methylene diformamides of which N,N-diacetyl methylamine diformamide is the preferred member. This material and analogous compounds are disclosed in British Patent Specification No. 1106666.

(c) Imidazoles

N-acyl imidazoles and similar five-membered ring systems form a further series of compounds useful as inorganic peroxy compound precursors. Specific examples are N-acetyl benzimidazole, N-benzoyl imidazole and its chloro- and methyl-analogues. Compounds of this type are disclosed in British Patent Specification Nos. 1234762, 1311765 and 1395760.

(d) Oximes

Oximes and particularly acylated oximes are also a useful class of organic peroxy compound precursors for the purpose of this invention. Oximes are derivatives of hydroxylamine from which they can be prepared by reaction with aldehydes and ketones to give aldoximes and ketoximes respectively. The acyl groups may be $C_1$–$C_{12}$ aliphatic or aromatic in character, preferred acyl groups being acetyl, propionyl, lauroyl, myristyl and benzoyl. Compounds containing more than one carbonyl group can react with more than one equivalent of hydroxylamine and the commonest class of dioximes are those derived from 1,2-diketones and ketonic aldehydes, such as dimethyl glyoxime

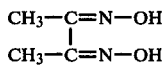

The acylated derivatives of this compound are of particular value as organic peroxy compound precursors, examples being diacetyl dimethyl glyoxime, dibenzoyl dimethyl glyoxime and phthaloyl dimethyl glyoxime.

(e) Carbonates

Substituted and unsubstituted aliphatic, aromatic and alicyclic esters of carbonic and pyrocarbonic acid have also been proposed as organic peroxy compound precursors. Typical examples of such esters are p-carboxy phenyl ethyl carbonate, sodium-p-sulphophenyl ethyl carbonate, sodium-p-sulphophenyl n-propyl carbonate and diethyl pyrocarbonate. The use of such esters as inorganic persalt activators in detergent compositions is set forth in British Patent Specification No. 970950.

In addition to the foregoing classes, numerous other materials can be utilised as organic peroxy compound precursors including triacyl guanidines of formula:

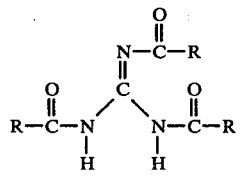

wherein R is alkyl, preferably acetyl or phenyl, prepared by the acylation of guanidine salt. Other classes of compounds include acyl sulphonamides, e.g. N-phenyl N-acetyl benzene sulphonamide as disclosed in British Patent Specification No. 1003310 and triazine derivatives such as those disclosed in British Patent Specification Nos. 1104891 and 1410555. Particularly preferred examples of triazine derivatives are the di- and triacetyl derivatives of 2,4,6,-trihydroxy-1,3,5-triazine, 2-chloro-4,6-dimethoxy-S-triazine and 2,4-dichloro 6-methoxy-S-triazine. Piperazine derivatives such as 1,4-diacylated 2,5-diketo piperazine as described in British Patent Specification Nos. 1339256 and 1339257 are also useful as are water-soluble alkyl and aryl chloroformates such as methyl, ethyl and phenyl chloroformate disclosed in British Patent Specification No. 1242106.

Of the foregoing classes of activators, the preferred classes are those that produce a peroxycarboxylic acid on reaction with an inorganic persalt. In particular the preferred classes are the imides, oximes and esters especially the phenol esters and imides.

Specific preferred materials are solid and are incorporated in the instant compositions in finely divided form, i.e., with an average particle size of less than about 500μ, more preferably less than about 350μ, especially less than about 150μ. Highly preferred materials include methyl o-acetoxy benzoate, sodium-p-acetoxy benzene sulphonate, Bisphenol A diacetate, tetra acetyl ethylene diamine, tetra acetyl hexamethylene diamine and tetra acetyl methylene diamine.

A third essential component of the bleach activator composition is a water-soluble or water-dispersible organic binding agent for the bleach precursor, for example, low molecular weight polyethylene glycols and glycol ethers, aromatic alcohols etc. A highly preferred binding agent, however, is an alkoxylated nonionic surfactant, especially a nonionic surfactant having detergency properties. Such nonionic surfactant materials can be broadly defined as compounds produced by the condensation of alkylene oxide groups (hydrophilic in nature) with an organic hydrophobic compound, which may be aliphatic or alkyl aromatic in nature. The length of the polyoxyalkylene group which is condensed with any particular hydrophobic group can be readily adjusted to yield a water-soluble compound having the desired degree of balance between hydrophilic and hydrophobic elements.

Examples of suitable nonionic surfactants include:

1. The polyethylene oxide condensates of alkyl phenol, e.g. the condensation products of alkyl phenols having an alkyl group containing from 6 to 12 carbon atoms in either a straight chain or branched chain configuration, with ethylene oxide, the said ethylene oxide being present in amounts equal to 5 to 14 moles of ethylene oxide per mole of alkyl phenol. The alkyl substituent in such compounds may be derived, for example, from polymerised propylene, di-isobutylene, octene and nonene. Other examples include dodecylphenol condensed with 9 moles of ethylene oxide per mole of phenol; dinonylphenol condensed with 11 moles of ethylene oxide per mole of phenol; nonylphenol and diisooctylphenol condensed with 12 moles of ethylene oxide.

2. The condensation product of primary or secondary aliphatic alcohols having from 8 to 24 carbon atoms, in either straight chain or branched chain configuration, with from 1 to about 14 moles of alkylene oxide per mole of alcohol. Preferably, the aliphatic alcohol comprises between 9 and 18 carbon atoms and is ethoxylated with between 3 and 12, desirably between 4 and 11 moles of ethylene oxide per mole of aliphatic alcohol. The preferred surfactants are prepared from primary alcohols which are either linear (such as those derived from natural fats or, prepared by the Ziegler process from ethylene, e.g. myristyl, cetyl, stearyl alcohols), or partly branched such as the Dobanols and Neodols which have about 25% 2-methyl branching (Dobanol and Neodol being Trade Names of Shell) or Synperonics, which are understood to have about 50% 2-methyl branching (Synperonic is a Trade Name of I.C.I.) or the primary alcohols having more than 50% branched chain structure sold under the Trade Name Lial by Liquicnimica. Specific examples of nonionic surfactants falling within the scope of the invention include Dobanol 45-4, Dobanol 45-7, Dobanol 45-9, Dobanol 91-3, Dobanol 91-6, Dobanol 91-8, Synperonic 6, Synperonic 14, the condensation products of coconut alcohol with an average of between 5 and 12 moles of ethylene oxide per mole of alcohol, the coconut alkyl portion having from 10 to 14 carbon atoms, and the condensation products of tallow alcohol with an average of between 7 and 12 moles of ethylene oxide per mole of alcohol, the tallow portion comprising essentially between 16 and 22 carbon atoms. Secondary linear alkyl ethoxylates are also suitable in the present compositions, especially those ethoxylates of the Tergitol series having from about 9 to 15 carbon atoms in the alkyl group and up to about 11, especially from about 3 to 9, ethoxy residues per molecule.

3. The compounds formed by condensing ethylene oxide with a hydrophobic base formed by the condensation of propylene oxide with propylene glycol. The molecular weight of the hydrophobic portion generally falls in the range of about 1500 to 1800. Such synthetic nonionic detergents are available on the market under the Trade Name of "Pluronic" supplied by Wyandotte Chemicals Corporation.

Of the above, highly preferred are alkoxylated nonionic surfactants having an average HLB in the range from about 9.5 to 13.5, especially 10 to 13.0 as this is found to provide granules having the optimum combination of hydrophobicity and water-dispersibility. Highly suitable nonionic surfactants of this type are ethoxylated primary or secondary $C_{9-18}$ alcohols having an average degree of ethoxylation from about 3 to 12, more preferably from about 4 to 11.

Various optional ingredients can be incorporated into the bleach activator and detergent compositions of the present invention in order to increase efficacy, particularly in the area of detergency and stain removal. The total amount of such optional ingredients normally lies in the range 1%–70%, preferably 1%–30% of the bleach activator composition when incorporated directly therein, or in the range 40%–99.5%, preferably 85%–99% when incorporated in the non-bleach activator portion of a detergent composition.

A highly preferred ingredient of the detergent compositions of the invention is a surfactant or mixture of surfactants, especially an anionic surfactant or a mixture thereof with nonionic, cationic, zwitterionic and ampholytic surfactant. The surfactant is preferably present in the non-bleach activator portion of the composition at a level of from about 1% to about 30%, more preferably from about 3% to about 20% of the total composition. A typical listing of the classes and species of these surfactants is given in U.S. Pat. No. 3,663,961 issued to Norris on May 23, 1972 and incorporated herein by reference.

Suitable synthetic anionic surfactants are water-soluble salts of alkyl benzene sulfonates, alkyl sulfates, alkyl polyethoxy ether sulfates, paraffin sulfonates, alpha-olefin sulfonates, alpha-sulfo-carboxylates and their esters, alkyl glyceryl ether sulfonates, fatty acid monoglyceride sulfates and sulfonates, alkyl phenol polyethoxy ether sulfates, 2-acyloxy-alkane-1-sulfonate, and beta-alkyloxy alkane sulfonate.

A particularly suitable class of anionic surfactants includes water-soluble salts, particularly the alkali metal, ammonium and alkanolammonium salts or organic sulfuric reaction products having in their molecular structure an alkyl or alkaryl group containing from about 8 to about 22, especially from about 10 to about 20 carbon atoms and a sulfonic acid or sulfuric acid ester group. (Includes in the term "alkyl" is the alkyl portion of acyl groups). Examples of this group of synthetic detergents which form part of the detergent compositions of the present invention are the sodium and potassium alkyl sulfates, especially those obtained by sulfating the higher alcohols ($C_{8-18}$) carbon atoms produced by reducing the glycerides of tallow or coconut oil and sodium and potassium alkyl benzene sulfonates, in which the alkyl group contains from about 9 to about 15, especially about 11 to about 13, carbon atoms, in straight chain or branched chain configuration, e.g. those of the type described in U.S. Pat. No. 2,220,099 and 2,477,383 and those prepared from alkylbenzenes obtained by alkylation with straight chain chloroparaffins (using aluminium trichloride catalysis) or straight chain olefins (using hydrogen fluoride catalysis). Especially valuable are linear straight chain alkyl benzene sulfonates in which the average of the alkyl group is about 11.8 carbon atoms, abbreviated as $C_{11.8}$ LAS.

Other anionic detergent compounds herein include the sodium $C_{10-18}$ alkyl glyceryl ether sulfonates, especially those ethers of higher alcohols derived from tallow and coconut oil; sodium coconut oil fatty acid monoglyceride sulfonates and sulfates; and sodium or potassium salts of alkyl phenol ethylene oxide ether sulfate containing about 1 to about 10 units of ethylene oxide per molecule and wherein the alkyl groups contain about 8 to about 12 carbon atoms.

Other useful anionic detergent compounds herein include the water-soluble salts or esters of $\alpha$-sulfonated fatty acids containing from about 6 to 20 carbon atoms in the fatty acid group and from about 1 to 10 carbon atoms in the ester group; water-soluble salts of 2-acyloxyalkane-1-sulfonic acids containing from about 2 to 9 carbon atoms in the acyl group and from about 9 to about 23 carbon atoms in the alkane moiety; alkyl ether sulfates containing from about 10 to 18, especially about 12 to 16, carbon atoms in the alkyl group and from about 1 to 12, especially 1 to 6, more especially 1 to 4 moles of ethylene oxide; water-soluble salts of olefin sulfonates containing from about 12 to 24, perferably about 14 to 16, carbon atoms, especially those made by reaction with sulfur trioxide followed by neutralization under conditions such that any sultones present are hydrolysed to the corresponding hydroxy alkane sulfonates; water-soluble salts of paraffin sulfonates containing from about 8 to 24, especially 14 to 18 carbon atoms, and $\beta$-alkyloxy alkane sulfonates containing from about 1 to 3 carbon atoms in the alkyl group and from about 8 to 20 carbon atoms in the alkane moiety.

The alkane chains of the foregoing non-soap anionic surfactants can be derived from natural sources such as coconut oil or tallow, or can be made synthetically as for example using the Ziegler or Oxo processes. Water solubility can be achieved by using alkali metal, ammonium or alkanolammonium cations; sodium is preferred. Magnesium and calcium are preferred cations under circumstances described by Belgian Pat. No. 843,636 invented by Jones et al, issued Dec. 30, 1976. Mixtures of anionic surfactants are contemplated by this invention; a preferred mixture contains alkyl benzene sulfonate having 11 to 13 carbon atoms in the alkyl group or paraffin sulfonate having 14 to 18 carbon atoms and either an alkyl sulfate having 8 to 18, preferably 12 to 18, carbon atoms in the alkyl group, or an alkyl polyethoxy alcohol sulfate having 10 to 16 carbon atoms in the alkyl group and an average degree of ethoxylation of 1 to 6.

Nonionic surfactants suitable for use in the detergent component of the present compositions include the alkoxylated surfactants previously described as binding agents for the bleach activator. Again, highly suitable nonionic surfactants of this type are ethoxylated primary or secondary $C_{9-15}$ alcohols having an average degree of ethoxylation from about 3 to about 9. Desirably, the total level of nonionic surfactant in the instant compositions is such as to provide a weight ratio of nonionic surfactant:anionic surfactant in the range from about 1:4 to about 4:1.

The addition of a water-soluble cationic surfactant to the present compositions has been found to be useful for improving the greasy stain removal performance. Suitable cationic surfactants are those having a critical micelle concentration for the pure material of at least 200 ppm and preferbly at least 500 ppm specified at 30° C. and in distilled water. Literature values are taken where possible, especially surfact tension or conductimetric values—see Critical Micelle Concentrations of Aqueous Surfactant System, P. Mukerjee and K. J. Mysels, NSRDS—NBS 37 (1971).

A high preferred group of cationic surfactants of this type have the general formula:

$$R^1{}_m R^2{}_{4-m} N\ Z$$

wherein $R^1$ is selected from $C_{8-20}$ alkyl, alkenyl and alkaryl groups; $R^2$ is selected from $C_{1-4}$ alkyl and benzyl groups; Z is an anion in number to give electrical neutrality; and m is 1, 2 or 3; provide that when m is 2 $R^1$ has less than 15 carbon atoms and when m is 3, $R^1$ has less than 9 carbon atoms.

Where m is equal to 1, it is preferred that $R^2$ is a methyl group. Preferred compositions of this monolong chain type include those in which $R^1$ is $C_{10}$ to $C_{16}$ alkyl group. Particularly preferred compositions of this class include $C_{12}$ alkyl trimethylammonium halide and $C_{14}$ alkyl trimethylammonium halide.

Where m is equal to 2, the $R^1$ chains should have less than 14 carbon atoms. Particularly preferred cationic materials of this calss include di-$C_8$ alkyldimethylammonium halide and di-$C_{10}$ alkyldimethylammonium halide materials.

Where m is equal to 3, the $R^1$ chains should be less than 9 carbon atoms in length. An example is trioctyl methyl ammonium chloride.

Another highly preferred group of cationic compounds have the general formula:

$R^1R^2_mR^3_{3-m}N^+A$ wherein $R^1$ represents a $C_{6-24}$ alkyl or alkenyl group or a $C_{6-12}$ alkaryl group, each $R^2$ independently represents a $(C_nH_{2n}O)_xH$ group where n is 2, 3 or 4 and x is from 1 to 14, the sum total of $C_nH_{2n}O$ groups in $R^2_m$ being from 1 to 14, each $R^3$ independently represents a $C_{1-12}$ alkyl or alkenyl group, an aryl group or a $C_{1-6}$ alkaryl group, m is 1, 2 or 3, and A is an anion.

In this group of compounds, $R^1$ is selected from $C_{6-24}$ alkyl or alkenyl groups and $C_{6-12}$ alkaryl groups; $R^3$ is selected from $C_{1-12}$ alkyl or alkenyl groups and $C_{1-6}$ alkaryl groups. When m is 2, however, it is preferred that the sum total of carbon atoms in $R^1$ and $R^3_{3-m}$ is no more than about 20 with $R^1$ representing a $C_{8-18}$ alkyl or alkenyl group More preferably the sum total of carbon atoms in $R^1$ and $R^1_{3-m}$ is no more than about 17 with $R^1$ representing a $C_{10-16}$ alkyl or alkenyl group. When m is 1, it is again preferred that the sum total of carbon atoms in $R^1$ and $R^3_{3-m}$ is no more than about 17 with $R^1$ representing a $C_{10-16}$ alkyl or alkaryl group.

Additionally in this group of compounds, the total number of alkoxy radicals in polyalkoxy groups ($R^2_m$) directly attached to the cationic charge centre should be no more than 14. Preferably, the total number of such alkoxy groups is from 1 to 7 with each polyalkoxy group ($R^2$)independently containing from 1 to 7 alkoxy groups; more preferably, the total number of such alkoxy groups is from 1 to 5 with each polyalkoxy group ($R^2$) independently containing from 1 to 3 alkoxy groups. Especially preferred are cationic surfactants having the formula:

$$R^1(C_nH_{2n}OH)_m(CH_3)_{3m}N^+A$$

wherein $R^1$ is as defined immediately above, n is 2 or 3 and m is 1, 2 or 3.

Particularly preferred cationic surfactants of the class having m equal to 1 are dodecyl dimethyl hydroxyethyl ammonium salts, dodecyl dimethyl hydroxypropyl ammonium salts, myristyl dimethyl hydroxyethyl ammonium salts and dodecyl dimethyl dioxyethylenyl ammonium salts. When m is equal to 2, particularly preferred cationic surfactants are dodecyl dihydroxyethyl methyl ammonium salts, dodecyl dihydroxypropyl methyl ammonium salts, dodecyl dihydroxyethyl ethyl ammonium salts, myristyl dihydroxyethyl methyl ammonium salts, cetyl dihydroxyethyl methyl ammonium salts, stearyl dihydroxyethyl methyl ammonium salts, oleyldihydroxyethyl methyl ammonium salts, and dodecyl hydroxy ethyl hydroxypropyl methyl amonium salts. When m is 3, particularly preferred cationic surfactants are dodecyl trihydroxyethyl ammonium salts, myristyl trihydroxyethyl ammonium salts, cetyl trihydroxyethyl ammonium salts, stearyl trihydroxyethyl ammonium salts, oleyl trihydroxy ethyl ammonium salts, dodecyl dihydroxyethyl hydroxypropyl ammonium salts and dodecyl trihydroxypropyl ammonium salts.

In the above, the usual inorganic salt counterions can be employed, for example, chlorides, bromides and borates. Salt counterions can also be selected from organic acid anions, however, such as the anions derived from organic sulphonic acids and from sulphuric acid esters. A preferred example of an organic acid anion is a $C_{6-12}$ alkaryl sulphonate.

Of all the above cationic surfactants, especially preferred are dodecyl dimethyl hydroxyethyl ammonium salts and dodecyl dihydroxyethyl methyl ammonium salts.

Additional preferred cationic surfactants are fully disclosed in British Patent Application No. 79-25946 and incorporated herein by reference.

The above water-soluble cationic surfactants can be employed in nonionic/cationic surfactant mixtures in a weight ratio of from about 10:6 to about 20:1, more preferably from about 10:2 to about 10:6, and particularly from about 10:3 to 10:5.

As mentioned earlier, a pH regulating agent is a further optional component of the present compositions and can be selected from inorganic or organic acids or acid salts or mixtures of such materials. Preferred inorganic agents include sodium and potassium bicarbonate and boric acid. Suitable organic agents include lactic acid, glycollic acid and ether derivatives thereof as disclosed in Belgium Pat. Nos. 821,368, 821,369 and 821,370; succinic acid, malonic acid, (ethylenedioxy) diacetic acid, maleic acid, diglyollic acid, tartaric acid, tartronic acid and fumaric acid; citric acid, aconitic acid, citraconic acid, carboxymethyloxy succinic acid, lactoxysuccinic acid, and 2-oxa-1,1,3-propane tricarboxylic acid; oxydisuccinic acid, 1,1,2,2-ethane tetracarboxylic acid, 1,1,3,3-propane tetracarboxylic acid and 1,1,2,3-propane tetracarboxylic acid; cyclopentane-cis, cis, cis-tetracarboxylic acid, cyclopentadienide pentacarboxylic acid, 2,3,4,5-tetrahydrofuran-cis, cis, cis-tetracarboxylic acid, 2,5-tetrahydrofuran-cis-cis dicarboxylic acid, 1,2,3,4,5,6-hexane-hexacarboxylic acid, mellitic acid, pyromellitic acid and the phthalicacid derivatives disclosed in British Patent No. 1,425,343; ethylene diamine tetra(methylenephosphonic acid), diethylene triamine penta(methylenephosphonic acid) and the acid salts of the above organic acids. Of the above, the preferred organic acids are citric, glycollic and lactic acids and the two phosphonic acids.

The pH regulating agent is desirably present in the agglomerate in an amount sufficient to provide a pH in 2% aqueous dispersion of the agglomerate, in the range from about 2 to 9.0, preferably from about 3 to 8.5, especially from about 4 to 7. If the detergent compositions contain perborate, however, the pH is preferably less than about 7 under these conditions. Generally, from about 0.5% to 25%, especially from about 1 to 10% of the regulating agent by weight of the agglomerate is sufficient.

Other optional ingredients which can be added to the present composition either as part of the agglomerate or as a separate particulate admixture include surfactants other than the nonionic and cationic surfactants specified hereinbefore, suds modifiers, chelating agents, anti-redeposition and soil suspending agents, optical brighteners, bactericides, anti-tarnish agents, enzymatic materials, fabric softeners, antistatic agents, perfumes, antioxidants and bleach catalysts.

Another optional ingredient of the agglomerate is a material for improving the crispness of the granule, eg, polyethylene glycol or $C_{16}$–$C_{22}$ fatty acid. Preferred agglomerates of this kind contain a mixture of the alkoxylated nonionic surfactant binding agent and polyethylene glycol (eg PEG 6000) or fatty acid (eg stearic acid) in a weight ratio of at least about 1:1, more preferably from about 2:1 to 6:1.

Other optional ingredients include suds modifiers particularly those of suds suppressing type, exemplified by silicones, and silica-silicone mixtures.

U.S. Pat. No. 3,933,672 issued Jan. 20, 1976, to Bartollota et al., incorporated herein by reference, discloses a silicone suds controlling agent. The silicone material can be represented by alkylated polysiloxane materials such as silica aerogels and xerogels and hydrophobic silicas of various types. The silicone material can be described as siloxane having the formula:

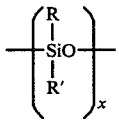

wherein x is from about 20 to about 2,000 and R and R' are each alkyl or aryl groups, especially methyl, ethyl, propyl, butyl and phenyl. The polydimethylsiloxanes (R and R' are methyl) having a molecular weight within the range of from about 200 to about 2,000,000, and higher, are all useful as suds controlling agents. Additional suitable silicone materials wherein the side chain groups R and R' are alkyl, aryl, or mixed alkyl or aryl hydrocarbyl groups exhibit useful suds controlling properties. Examples of the like ingredients include diethyl-, dipropyl-, dibutyl-, methyl-, ethyl-, phenylmethylpolysiloxanes and the like. Additional useful silicone suds controlling agents can be represented by a mixture of an alkylated siloxane, as referred to hereinbefore, and solid silica. Such mixtures are prepared by affixing the silicone to the surface of the solid silica. A preferred silicone suds controlling agent is represented by a hydrophobic silanated (most preferably trimethylsilanted) silica having a particle size in the range from about 10 millimicrons to 20 millimicrons and a specific surface area above about 50 $m^2/g$. intimately admixed with dimethyl silicone fluid having a molecular weight in the range from about 500 to about 200,000 at a weight ratio of silicone to silanated silica of from about 1:1 to about 1:2. The silicone suds suppressing agent is advantageously releasably incorporated in a water-soluble or water-dispersible, substantially non-surface-active detergent-impermeable carrier.

Particularly useful suds suppressors are the self-emulsifying silicone suds suppressors, described in German Patent Application DTOS 2,646,126 published Apr. 28, 1977 and incorporated herein by reference. An example of such a compound is DS-544, commercially available from Dow Corning, which is a siloxane/glycol copolymer.

Suds modifiers as described above are used at levels of up to approximately 5%, preferably from 0.1 to 2% by weight of the nonionic surfactant. They can be incorporated into the particulates of the present invention or can be formed into separate particulates that can then be mixed with the particulates of the invention. The incorporation of the suds modifiers as separate particulates also permits the inclusion therein of other suds controlling materials such as $C_{20}$–$C_{24}$ fatty acids, microcrystalline waxes and high MWt copolymers of ethylene oxide and propylene oxide which would otherwise adversely affect the dispersibility of the matrix. Techniques for forming such suds modifying particulates are disclosed in the previously mentioned Bartolotta et al U.S. Pat. No. 3,933,672.

Preferred soil suspending and anti-redeposition agents include methyl cellulose derivatives and the copolymers of maleic anhydride and either methyl vinyl ether or ethylene.

Another class of stain removal additives useful in the present invention are enzymes.

Preferred enzymatic materials include the commercially available amylases, and neutral and alkaline proteases conventionally incorporated into detergent compositions. Suitable enzymes are discussed in U.S. Pat. Nos. 3,519,570 and 3,533,139.

In the Examples which follow, the abbreviations used have the following designation:

| | |
|---|---|
| LAS | Linear $C_{12}$ alkyl benzene sulphonate |
| TAS | Sodium tallow alcohol sulfate |
| $TlAE_n$ | Tallow alcohol ethoxylated with n moles of ethylene oxide per mole of alcohol |
| CTMAC | Coconut trimethyl ammonium chloride |
| CDMAC | Coconut alkyl dihydroxyethyl methyl ammonium chloride |
| Dobanol 45-E-7 | A $C_{14-15}$ oxo-alcohol with 7 moles of ethylene oxide, marketed by Shell |
| Dobanol 45-E-4 | A $C_{14-15}$ oxo alcohol with 4 moles of ethylene oxide, marketed by Shell |
| Dobanol 91-E-3 | A $C_{9-11}$ oxo alcohol with 4 moles of ethylene oxide, marketed by Shell |
| TAED | Tetraacetyl ethylene diamine |
| AOBS | Sodium p-acetoxy benzene sulphonate |
| TAHD | Tetraacetyl hexamethylene diamine |
| Imvite | Sodium montmorillonite marketed by IMV, Nevada U.S.A. |
| M100 | Calcined kaolin marketed by English China Clays |
| Zeolite A | Prepared by alkali treatment of metakaolin |
| Silicate | Sodium silicate having an $SiO_2$:$Na_2O$ ratio of 1.6. |
| Wax | Microcrystalline wax - Witcodur 272 M.pt 87° C. |
| Silicone Prill | Comprising 0.14 parts by weight of an 85:15 by weight mixture of silanated silica and silicone, granulated with 1.3 parts of sodium tripolyphosphate, and 0.56 parts of tallow alcohol condensed with 25 molar proportions of ethylene oxide |
| Gantrez AN119 | Tradename for maleic anhydride/vinyl methyl ether copolymer, believed to to have an average molecular weight of about 240,000, marketed by GAF. This was prehydrolysed with NaOH before addition. |
| Brightener | Disodium 4,4'-bis(2-morpholino-4-anilino-s-triazin-6-ylamino) stilbene-2:2'-disulphonate. |
| Dequest 2060 | Tradename for diethylene triamine penta(methylene phosphonic acid), marketed by Monsanto. |
| Dequest 2041 | Tradename for ethylenediamine tetra (methylene phosphonic acid), marketed by Monsanto. |

The present invention is illustrated by the following examples:

EXAMPLES I–VI

The following bleach activator agglomerates are prepared by spraying a mixture of the liquid or liquifiable ingredients (nonionic, cationic surfactants silicone oil etc.) onto a mixture of the non-silicate solid ingredients (bleach activator, phosphonic acids etc.) in a pan granulator, followed by spray-on of clay, zeolite or magnesium silicate respectively to provide agglomerates having a surface coating of water-insoluble silicate.

| | EXAMPLES | | | | | |
|---|---|---|---|---|---|---|
| | I | II | III | IV | V | VI |
| Dobanol 45-E-7 | — | 12 | 15 | 10 | 12 | — |
| Dobanol 45-E-4 | — | 8 | — | — | — | — |
| Dobanol 91-E-3 | 10 | — | — | — | 2 | — |
| $TlAE_{11}$* | 12 | — | — | — | — | 15 |
| CTMAC | — | — | — | — | 2 | — |
| CDMAC | — | 5 | — | — | — | — |
| LAS | — | — | — | 5 | 2 | — |
| Silicone oil | 2 | — | — | — | — | — |
| Imvite (13% moisture) | 12 | — | — | — | 16 | — |
| M100 (0.6% moisture) | — | 15 | — | — | — | — |
| Zeolite A | — | — | — | 14 | — | — |
| Magnesium silicate ($MgO:SiO_2$ = 0.3125) | — | — | 20 | — | — | 15 |
| TAED (Particle size 150 to 250μ) | — | — | 65 | 60 | — | 70 |
| AOBS | — | 56.3 | — | — | 60 | — |
| TAHD | 61 | — | — | — | — | — |
| Dequest 2041 | — | 3 | — | 5 | — | — |
| Dequest 2060 | — | — | — | — | 3 | — |
| Gantrez AN119 | 3 | — | — | — | 3 | — |
| Polyethyleneglycol 6000 | — | — | — | 5 | — | — |
| Perfume and butoxylated hydroxy-toluene | — | 0.7 | — | 1 | — | — |

*Melting Transition (Dupont R90 Differential Scanning Calorimeter) 25–36° C.; average 32°; sample preheated to 100° and quenched cooled to −10° C.; heating rate 1° C./Minute.

The above products are non-bleeding, free-flowing granular compositions having high granule strength, low dust and low moisture pick-up on storage at 32° and 80% relative humidity; they have excellent activator storage stability and rapid dispersibility in aqueous detergent media, and when added to an aqueous perborate-containing detergent medium, they provide rapid generation of peroxy acetic acid (i.e. at least about 50%, and in some instances at least 80%, of the theoretical yield within about 8 minutes of addition at 25° C. to a standard detergent solution containing 16,000 ppm tetrasodium pyrophosphate, 1800 ppm sodium perborate tetrahydrate and 36 ppm sodium ethylene diamine tetraacetate), with only a slow loss of peroxy acetic acid activity thereafter.

EXAMPLES VII TO XI

The following detergent compositions are prepared by dry-mixing bleach activator agglomerates (I) made by the process of Examples I to VI, with auxiliary granular mixtures (II) prepared by spray drying and, where appropriate, with sodium perborate tetrahydrate, silicone prill, enzyme and phosphonate.

| | EXAMPLES | | | | |
|---|---|---|---|---|---|
| | VII | VIII | IX | X | XI |
| Granules I | | | | | |
| Dobanol 45-E-7 | — | 15 | 10 | 13 | 15 |
| Silicone oil | — | — | — | 1.5 | — |
| Imvite | — | — | — | 22 | — |
| M100 | — | 20 | — | — | — |
| Zeolite | — | — | 20 | — | — |
| $TAE_{11}$ | 18 | — | — | — | — |
| Magnesium silicate ($MgO:SiO_2$ - 0.3125) | 12 | — | — | — | 15 |
| TAED | 70 | — | 60 | 56 | 70 |
| AOBS | — | 65 | — | — | — |
| Gantrez AN119 | — | — | — | — | — |
| Dequest 2041 | — | — | 10 | 7 | — |
| Brightener | — | — | — | 0.5 | — |

-continued

| | EXAMPLES | | | | |
|---|---|---|---|---|---|
| | VII | VIII | IX | X | XI |
| Granules II | | | | | |
| LAS | 6 | 12 | — | 2 | 8 |
| TAS | 2 | — | 10 | — | — |
| CTMAC | — | — | 3 | — | 2 |
| Dobanol 45-E-4 | — | — | — | 4 | — |
| Dobanol 45-E-7 | — | — | 5 | 8 | 5 |
| Sodium tripolyphosphate | 33 | 40 | 30 | 60 | 45 |
| Silicate | 10 | 8 | — | — | 9 |
| Dequest 2041 | 0.5 | — | — | — | 0.3 |
| Wax | — | 2 | 2 | — | 3 |
| Gantrez AN119 | — | — | 0.5 | — | 0.4 |
| Brightener | 0.5 | — | 0.5 | — | 0.3 |
| Sodium sulphate, miscellaneous & moisture | 48 | 38 | 49 | 26 | 27 |
| Final Composition | | | | | |
| Granules I | 3 | 5 | 10 | 14 | 3 |
| Granules II | 66 | 82 | 65 | 70 | 72 |
| Sodium perborate tetrahydrate | 30 | 10 | 25 | 15 | 22 |
| Silicone prill | — | 2 | — | — | 2 |
| Alcalase enzyme | 1 | — | — | 1 | 1 |
| Dequest 2041 | — | 1 | — | — | — |

The above products are free-flowing granular compositions having excellent detergency performance on bleachable stains at both low and high wash temperatures and displaying excellent physical and chemical storage characteristics.

EXAMPLES XII TO XVI

The following detergent compositions are prepared by making bleach activator agglomerates (I) using the process of Examples I to VI, screening the agglomerates through a 1.4 mm sieve onto an 841 micron sieve, and then dry mixing the agglomerates with auxiliary granular mixtures (II) prepared by spray drying and, where appropriate, with sodium perborate tetrahydrate, silicone prill, enzyme and phosphonate.

| | EXAMPLES | | | | |
|---|---|---|---|---|---|
| | XII | XIII | XIV | XV | XVI |
| Granules I | | | | | |
| Dobanol 45-E-7 | — | 15 | 10 | — | — |
| Imvite | — | — | — | 1.5 | — |
| M100 | — | 1 | — | — | — |
| Zeolite | — | — | 1.5 | — | — |
| $TAE_{11}$ | 14 | 5 | — | 13 | 15.6 |
| Magnesium silicate ($MgO:SiO_2$-0.3125) | 2 | — | — | — | 1.4 |
| TAED | 84 | 73 | 78.5 | 78 | 83 |
| Dequest 2041 | — | 6 | 10 | 7 | — |
| Brightener | — | — | — | 0.5 | — |
| Granules II | | | | | |
| LAS | 6 | 12 | — | 2 | 8 |
| TAS | 2 | — | 10 | — | — |
| CTMAC | — | — | 3 | — | 2 |
| Dobanol 45-E-4 | — | — | — | 4 | — |
| Dobanol 45-E-7 | — | — | 5 | 8 | 5 |
| Sodium tripolyphosphate | 33 | 40 | 30 | 60 | 45 |
| Silicate | 10 | 8 | — | — | 9 |
| Dequest 2041 | 0.5 | — | — | — | 0.3 |
| Wax | — | 2 | 2 | — | 3 |
| Gantrez AN119 | — | — | 0.5 | — | 0.4 |
| Brightener | 0.5 | — | 0.5 | — | 0.3 |
| Sodium sulphate, miscellaneous & moisture | 48 | 38 | 49 | 26 | 27 |
| Final Compositions | | | | | |
| Granules I | 3 | 5 | 10 | 14 | 3 |
| Granules II | 66 | 82 | 65 | 70 | 72 |
| Sodium perborate | 30 | 10 | 25 | 15 | 22 |

-continued

| | EXAMPLES | | | | |
|---|---|---|---|---|---|
| | XII | XIII | XIV | XV | XVI |
| tetrahydrate | | | | | |
| Silicone prill | — | 2 | — | — | 2 |
| Alcalase enzyme | 1 | — | — | 1 | 1 |
| Dequest 2041 | — | 1 | — | — | — |

The above products are free-flowing granular compositions having excellent activator storage stability and rapid dispersibility in aqueous detergent media, even at low temperatures, and they provide excellent detergency performance on bleachable stains at both low and high wash temperatures.

What is claimed is:

1. A granular bleach activator composition in the form of an agglomerate comprising by weight thereof:
   (a) at least 75% of finely-divided organic peroxy acid bleach precursor,
   (b) from 8% to 15% of water-soluble or water-dispersible organic binding agent for the bleach precursor, the binding agent having a melting point of no more than 40° C. and being selected from the group consisting of ethoxylated primary or secondary alcohols having an average degree of ethoxylation from 3–12 inclusive and an average HLB in the range from 9.5 to 13.5,
   (c) from 1.2% to 2.1% of finely-divided water-insoluble natural or synthetic silica or silicate as a surface-coating agent for the agglomerate, the weight ratio of the bleach precursor binding agent to surface-coating agent being 10:1 or less.

2. A composition according to claim 1 wherein the water-insoluble silicate is selected from the group consisting of:
   (a) aluminosilicates having the general formula I:

$$Na_z(AlO_2)_z(SiO_2)_yxH_2O \qquad \text{I}$$

wherein z and y are integers of at least 6, the molar ratio of z to y is in the range from 1.0 to 0.5 and x is a number such that the moisture content of the aluminosilicate is from 10% to 28% by weight thereof,
   (b) magnesium silicates of formula II:

$$n\ M_gO{:}SiO_2 \qquad \text{II}$$

wherein n is in the range from 0.25 to 4.0,
   (c) smectite-type clays selected from the group consisting of alkali and alkaline earth metal montmorillonites, saponites and hectorites,
   (d) kaolinite-type clays selected from the group consisting of kaolin, calcined kaolin, and metakaolin, and
   (e) mixtures thereof.

3. A granular bleach activator composition as recited in claim 2 wherein the surface-coating agent is magnesium silicate.

4. A granular bleach activator composition as recited in claim 3 wherein n in the magnesium silicate formula ranges from about 0.3 to about 1.5 and the magnesium silicate is colloidal.

5. A composition according to claim 3 comprising:
   (a) from 0.5% to 60% of the granular bleach activator composition, and
   (b) from 40% to 99.5% of auxiliary detergent components in powder form comprising:
      (i) from 5% to 35% of inorganic percompound yielding hydrogen peroxide in water,
      (ii) from 1% to 30% of anionic surfactant, optionally in combination with nonionic, cationic, zwitterionic or ampholytic surfactant or mixture thereof, and
      (iii) from 2% to 93.5% of detergency building.

6. A composition according to claim 3 additionally comprising a polyphosphonic acid or salt thereof having the general formula III:

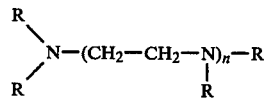

III in which n is an integral number from 1 to 14 and each R is individually hydrogen or $CH_2PO_3H_2$ or a water-soluble salt thereof, provided that at least half of the radicals represented by R are $CH_2PO_3H_2$ radicals or water-soluble salts thereof, wherein the weight ratio of water-insoluble silica or silicate to the polyphosphonic acid is the ratio of 100:1 to 1:5.

7. A composition according to claim 3, in which the peroxy acid bleach precursor is selected from the group consisting of N,N,N',N'-tetra acetylated compounds having the formula

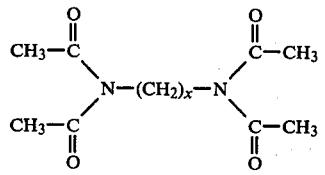

in which x is O or an integer from 1 to 6.

8. A composition according to claim 7, in which the peroxy acid bleach precursor is tetra acetyl ethylene diamine.

9. A granular detergent composition comprising from 0.5% to 100% thereof of a granular bleach activator composition in the form of an agglomerate comprising by weight thereof:
   (a) at least 75% of finely-divided organic peroxy acid bleach precursor,
   (b) from 8% to 15% of water-soluble or water-dispersible organic binding agent for the bleach precursor, the binding agent having a melting point of no more than 40° C. and being selected from the group consisting of ethoxylated primary or secondary alcohols having an average degree of ethoxylation from 3–12 inclusive and an average HLB in the range from 9.5 to 13.5,
   (c) from 1.2% to 2.1% of finely-divided water-insoluble natural or synthetic silica or silicate as a surface-coating agent for the agglomerate, the weight ratio of the bleach precursor binding agent to surface-coating agent being 10:1 or less.

10. A composition according to claim 9 wherein the water-insoluble silicate is selected from the group consisting of:
   (a) aluminosilicates having the general formula I:

$$Na_z(AlO_2)_z(SiO_2)_yxH_2O \qquad \text{I}$$

wherein z and y are integers of at least 6, the molar ratio of z to y is in the range from 1.0 to 0.5 and x is a number such that the moisture content of the aluminosilicate is from 10% to 28% by weight thereof, (b) magnesium silicates of formula II:

$$n\ M_gO{:}SiO_2 \qquad \text{II}$$

wherein n is in the range from 0.25 to 4.0, (c) smectite-type clays selected from the group consisting of alkali and alkaline earth metal montmorillonites, saponites and hectorites, (d) kaolinite-type clays selected from the group consisting of kaolin, calcined kaolin, and metakaolin, and (e) mixtures thereof.

11. A granular detergent composition as recited in claim 10 wherein the surface-coating agent is magnesium silicate.

12. A granular detergent composition as recited in claim 11 wherein n in the magnesium silicate formula ranges from about 0.3 to about 1.5 and the magnesium silicate is colloidal.

13. A composition according to claim 11 comprising:

(a) from 0.5% to 60% of the granular bleach activator composition, and (b) from 40% to 99.5% of auxiliary detergent components in powder form comprising:

(i) from 5% to 35% of inorganic percompound yielding hydrogen peroxide in water, (ii) from 1% to 30% of anionic surfactant, optionally in combination with nonionic, cationic, zwitterionic or ampholytic surfactant or mixture thereof, and (iii) from 2% to 93.5 of detergency builder.

14. A composition according to claim 11 additionally comprising a polyphosphonic acid or salt thereof having the general formula III:

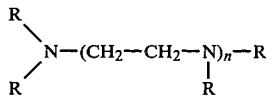

III in which n is an integral number from 1 to 14 and each R is individually hydrogen or $CH_2PO_3H_2$ or water-soluble salt thereof, provided that at least half of the radicals represented by R are $CH_2PO_3H_2$ radicals or water-soluble salts thereof, wherein the weight ratio of water-insoluble silica or silicate to the polyphosphonic acid is the ratio of 100:1 to 1:5.

15. A composition according to claim 11, in which the peroxy acid bleach precursor is selected from the group consisting of N,N,N',N'-tetra acetylated compounds having the formula

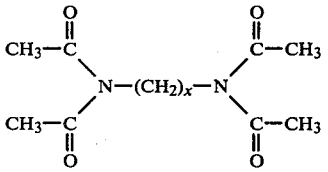

wherein x is O or an integer from 1 to 6.

16. A composition according to claim 15, in which the peroxy acid bleach precursor is tetra acetyl ethylene diamine.

17. A process of making a composition according to claim 3 comprising forming particles of a mixture of the bleach precursor and binding agent, the particles having an average particle size of less than 3000 microns, and thereafter coating the particles with the finely-divided water-insoluble natural or synthetic silica or silicate, thereby forming the agglomerate.

18. A process of making a composition according to claim 3 comprising dispersing the binder in liquid form onto a moving bed of the bleach precursor and subsequently dispersing the finely-divided water-insoluble natural or synthetic silica or silicate onto a moving bed of the mixture of bleach precursor and binder, thereby forming the agglomerate.

19. A process of making a composition according to claim 11 comprising forming particles of a mixture of the bleach precursor and binding agent, the particles having an average particle size of less than 3000 microns, and thereafter coating the particles with the finely-divided water-insoluble natural or synthetic silica or silicate, thereby forming the agglomerate.

20. A process of making a composition according to claim 11 comprising dispersing the binder in liquid form onto a moving bed of the bleach precursor and subsequently dispersing the finely-divided water-insoluble natural or synthetic silica or silicate onto a moving bed of the mixture of bleach precursor and binder, thereby forming the agglomerate.

* * * * *